219-121 SR
6/8/76 XR 3,962,486

United States Patent [19]
Gerek et al.
[11] 3,962,486
[45] June 8, 1976

[54] NOVEL PROCESS FOR APPLYING THERMOSET RESINOUS COATINGS

[75] Inventors: Gene Gerek; Robert G. Coucher, both of Salt Lake City, Utah

[73] Assignee: EPPCO, Salt Lake City, Utah

[22] Filed: Jan. 2, 1974

[21] Appl. No.: 430,094

[52] U.S. Cl. ..... 427/34; 219/121 P; 427/423
[51] Int. Cl.[2] ..... B05D 1/08
[58] Field of Search ..... 117/93.1 PF, 21, 17; 219/76, 121 P; 427/34, 423

[56] References Cited

UNITED STATES PATENTS

| | | | |
|---|---|---|---|
| 3,179,784 | 4/1965 | Johnson | 117/93.1 PF |
| 3,183,337 | 5/1965 | Winzeler et al. | 117/93.1 PF |
| 3,378,391 | 4/1968 | Winzeler et al. | 117/93.1 PF |

*Primary Examiner*—John H. Newsome
*Attorney, Agent, or Firm*—Trask & Britt

[57] ABSTRACT

A novel process for applying cured thermoset resinous coatings to various kinds of substrates and in particular, to thin metal substrates, is disclosed. Finely divided thermosettable resinous particles containing a solid catalyst are introduced into a region of a plasma arc generated flame having a temperature greater than the melting point of said resin. The residence time of said resinous particles in the vicinity of said flame is maintained for a period sufficient to liquify substantially said particles and to initiate polymerization of the thermosettable resin particles. The liquified resin particles are propelled towards a substrate with sufficient velocity to cause said liquified resinous particles to impact with sufficient force to cause said particles to flow upon said substrate to coat same with a continuous, thin coating. The coated substrate is then cooled at a rate sufficiently slow to permit said coating to cure. The plasma flame must be located sufficiently near the substrate so that the resinous particles possess sufficient thermal and kinetic energy to flow into a thin coating retaining sufficient energy therein to continue curing to a thermoset state without addition of energy. The kinetic energy of the particle facilitates formation of a thin, uniform coating and creates additional thermal energy upon impact with said substrate.

12 Claims, 2 Drawing Figures

NOVEL PROCESS FOR APPLYING THERMOSET RESINOUS COATINGS

BACKGROUND OF THE INVENTION

Thin coatings formed of thermoset resins, pigmented and unpigmented, have generally been applied as emulsions; e.g., water dispersed systems or as solutions involving organic solvents. These systems are well known and have been extensively used for many years as the mainstay of the resinous coatings industry.

Solvent based coating systems have a distinct disadvantage since such systems are generally about 60 to 80 percent solvent and only about 20 to 40 percent resin. The organic solvents prevalent for dissolving resins are generally noxious, frequently toxic and are generally considered as air pollutants and health hazards. Water dispersed coatings do not have these disadvantages but thus far they have found little utility as an industrial coating; e.g., as coatings for appliances, automobiles, business equipment, machinery and like, which require, either by reason of service or aesthetics, a high-gloss, easily cleaned surface. Such a surface is not presently available from water based systems. Because of certain federal, state and municipal air pollution standards being imposed and contemplated, the coatings industry is generally without a complying system; i.e., a solvent-free system, to provide thin, high-gloss, easily cleaned surfaces.

Although 100% solids coating systems are available in liquid form; e.g., styrene-unsaturated polyester resin systems, or liquid epoxy, the viscosities of such systems are so high that they cannot be readily sprayed to form thin coatings.

Powder coating systems have, thus far, not offered the full range of properties available in solvent based systems. Powder coating systems generally comprise finely divided particles of thermoplastic or thermosettable resins which can be applied in a fluid bed or by electrostatic spray techniques. The resulting films are generally thick, especially when applied in a fluid bed, and do not have a high gloss, especially when applied by electrostatic techniques. Also, each of these application techniques have certain inherent limitations; e.g., large objects, continuous strips to be coated on one side only, are not readily coated in a fluid bed while some objects such as beverage containers (soft drink and beer cans) cannot be effectively coated on the interior by electrostatic techniques. Also, a coating applied by either technique must subsequently be heated to effect a cure thereof if the coating is thermosettable. Postheating is a further requirement for thicker epoxies or vinyl resins.

The present invention provides a process for applying finely divided thermosettable resin particles to a substrate to form thin, high-gloss coatings which are cured as applied and do not require a subsequent baking. As indicated hereinabove, the process utilizes a plasma spray flame to melt the resin particles as they are propelled towards a substrate.

Although thermoplastic organic resin particles have previously been introduced into a plasma arc flame in order to apply a coating to a substrate, the resulting films have not been ultra thin. Illustrative of such techniques are the disclosures of U.S. Pat. No. 3,179,784 of Johnson, British Pat. No. 1,087,173, and U.S. Pat. No. 3,676,638 of Stand. The emphasis indicated in each of these patents have been directed towards applying PTFE (polytetrafluroethylene) coatings and polyethylene and polypropylene. Although Johnson mentions thermoplastic solid resin particles generally, no specific reference was made to polyvinyl chloride resins and polyvinyl acetate resins, which are predominant thermoplastic powder resins, and which have exhibited unsatisfactory results, as indicated hereinafter, when attempts have been made to apply a coating of same by use of a plasma arc spray technique.

U.S. Pat. No. 3,378,391 of Winzeler also relates to spraying plastic powders by a plasma spray technique. It is indicated therein that an epoxy powder was sprayed which melted and hardened on a substrate. No reference is made therein to cured, thin films of epoxy resins. As indicated hereinafter, a hardened, uncured epoxy film can be applied by liquifying epoxy powder in a plasaspray device.

Thermoplastic particles are similar to metals when processed through a plasma arc flame in that the mechanism of forming a coating involves melting of the particle, directing the particle to the substrate and allowing the substrate and paraticle to cool, whereby the particle again has the same chemical and physical properties. This characteristic of a thermoplastic coating is the same regardless of the method of applying, although in some instances the particle will be applied to the substrate before it is melted; e.g., electrostatic spray.

The mechanism of forming a cured coating from a thermosettable resinous particle is more complex. The particle generally comprises a low molecular weight polymer having reactive sites through which the polymer may cross-link to form a thermoset polymer. The cross-linking rection frequently requires a catalyst to initiate and promote the reaction. The reaction preferably occurs at elevated temperatures, otherwise a catalyzed resinous particle has no storage stability at room temperatures. The cross-linking reaction may be exothermic or endothermic. In either instance, however, it may be necessary to supply heat to the resin to complete the reaction inasmuch as the heat loss from the resin may be greater than the heat generated from the exothermic reaction.

DESCRIPTION OF THE INVENTION

Figure 1:
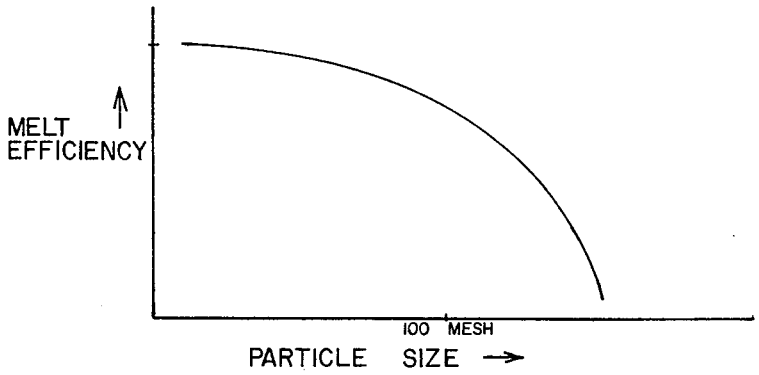
FIG. 1 graphically illustrates the relationship between meelt efficiency and particle size.

A novel process for applying cured, thermoset resinous coatings to various kinds of substrates has now been invented. Finely divided particles; i.e. particles of less than about 100 microns in thickness, of thermosettable resins containing a homogeneously dispersed solid catalyst having an activation temperature less than the degradation point of said resin are introduced into a region of a plasma arc generated flame having a temperature greater than the melting point of said resin. The residence time of said resinous particles in the vicinity of said flame is maintained for a period sufficient to liquify substantially said particles, activate said catalyst, and to initiate polymerization of the thermosettable resinous particles. The flame velocity is established at a sufficiently high level to propel said resinous particles towards a substrate with sufficient velocity to cause said liquified resinous particles to impact said substrate with sufficient force to cause said particles to flow upon said substrate to coat same with a thin coating which cures to a substantially fully cured state by controlling the cooling rate of said coating.

The plasma flame is located sufficiently near the substrate; e.g., about two inches to six inches typically for flat substrates, so that the resinous particles retain sufficient thermal and kinetic energy to flow into a thin coating which possesses sufficient energy to continue curing to a thermoset state witout addition of energy. The kinetic energy of a resin particle is preferably of sufficient magnitude to facilitate formation of a thin, uniform coating and to create additional thermal energy upon impact with said substrate.

Under optimum conditions it is unnecessary to preheat or post-heat the substrate to effect a substantially full cure of the thermoset coating. The degree of cure is readily determined by such characteristics as solvent resistance, fabricating ability, hardness, adhesion, and post-flow upon exposure to temperatures above the resin melting point. Typically the application of liquified resinous particles raises the substrate temperature only slightly; e.g., paper, cloth and other flammable substrates may be coated. It is usually unnecessary to pre-heat or post-heat the substrate to effect curing of the resin to a fully cured or, at least, a commercially useful cured condition, although coating a thick metal substrate or other substrate which acts as a heatsink may result in an uncured or a less fully cured coating than a coating on a thin metal substrate applied under similar conditions.

Since a practical maximum exists for the amount of energy possessed by a particle, because of temperature and velocity considerations, it may be necessary to pre-heat or post-heat thicker substrates, especially substrates having a relatively high thermal conductivity, to obtain a coating having a commercially desirable degree of cure. The temperature of the resin is necessarily maintained below its degradation temperature and the velocity of the particles preferably maintained below sonic levels for ecological reasons. The plasma spray process of the instant invention is unique in imparting a very large amount of energy, which is the sum of the thermal and kinetic energy, into the particle prior to contact with a substrate.

INTRODUCTION OF RESIN INTO FLAME

The resin particles are introduced into the flame either from a position inside or outside the gun. Introducing the resin particles into the flame externally to the gun generally involves introducing the resin at a point near the gun in a manner so that substantially all the resin is entrained in the flame. Introducing the resin at an acute angle to the flame is preferable in some instances. The point of introduction is one factor which determines residence time of the resin in vicinity of the flame.

The resin particles may also be introduced into the chamber of the gun and enter the discharging ionized gas stream before it discharges from the gun. Since the point of introduction is fixed in internal feeding of the resin, the residence time is a function only of velocity and distance which the resinous particles travel in the flame. If the distance from gun to substrate exceeds the flame length, then the residence time is substantially the same regardless of velocity since increasing velocity increases flame length. In order to prevent overheating of the resin particles beyond their degradation point, the flame temperature may be controlled by the amount of power input to the gun. Also, the resin temperature may be controlled by introducing diluent gases into the ionized gas stream internally of the gun immediately before discharge. The introduction of diluent gases is further advantageous in producing a more uniform temperature gradient across the flame, thereby diminishing temperature differentials among the particles. It is, of course, preferred to have each particle possess the same temperature and energy level.

It is generally preferred that a long flame gun be utilized in spraying thermoset resinous particles to form a cured coating. Flame length, a function of velocity and ionizing gas composition, is determined by nozzle diameter and gas volume. Thus, a gun having a certain power level will produce a flame of a certain maximum length dependent upon nozzle diameter. A long flame; i.e., a flame length of about two inches to four inches is generally preferred. Although the flame temperature at a given velocity and flame length may be varied by varying the composition of ionizing gas, it is generally preferred to transfer heat to the resin particles by exposure to a lower temperature flame for a longer period rather than effect heat transfer from a hotter flame for a shorter period. The latter situation presents greater risk of resin degradation at the particle surface coupled with an unliquified resin center.

At a given power level, the gun will produce a flame having a certain maximum velocity for a certain gas composition inasmuch as a higher gas rate overloads the ionizing potential of the gun; i.e., extinguishes the flame. The following table illustrates this for a gun having a maximum power rating of 10 KW and a nozzle diameter of 0.228 inches.

TABLE I

| Volts | Amps | Gas Flow A(CFH) | Gas Flow N(CFH) | Flame Length Inches | Approx. Velocity |
|---|---|---|---|---|---|
| 35 | 75 | 15 | 4.5 | 2 | Low |
| 40 | 100 | 18 | 12 | 3 | Intermediate |
| 50 | 100 | 20 | 15 | 3.5–4 | High (>mach 1) |

INITIATING POLYMERIZATION

As indicated hereinabove, thermosetting resin particles; e.g. epoxy resin particles, contain a solid catalyst preferably uniformly dispersed through the resin. Catalyst activation temperature less than the resin degradation temperature is required and preferably is near or slightly below the resin melting point although a catalyst which activates at a low temperature may render the resin unstable unless it is maintained at cryogenic temperaures.

The catalyst is activated during residence of the resin in the vicinity of the plasma arc flame. The molten resin particle begins polymerization upon activation of the catalyst. Polymerization of the resin continues so long as the resin remains at or near the catalyst initiation temperature. Although the polymerization reaction is typically exothermic, the heat loss from the resin particle during its travel to the substrate and on the substrate may be so great as to cool the resin prematurely before polymerization is completed. Thus, although polymerization is initiated in the vicinity of the flame, if the resin temperature is too low, or the particle velocity too low, or the substrate too cool or of large mass, the resin will form a substantially uncured coating upon the substrate. Because of particle size, heat loss and velocity attenuation occur quickly during travel of the particle from gun to substrate.

The thermosettable resin particles which do not contact the substrate may be collected and recycled to the plasma spray gun. Even though thermosettable particles striking the substrate cure to a substantially fully cured state, those particles missing the substrate are substantially non-polymerized and can be passed through a plasma spray gun a second time to form a fully cured film upon a substrate.

As indicated hereinabove, a thermosettable resin particle must reside in the vicinity of the plasma flame for a period sufficiently long to allow catalyst activation and polymerization initiation. In addition to polymerization initiation, the plasma gun must impart sufficient thermal and kinetic energy to said particles to cause said particles to achieve a cured, thermoset condition shortly after impact with an appropriately located substrate.

For most purposes the plasma flame may have an actual temperature which is many fold the resin melting point, but degradation of the resin is avoided because of the comparatively short residence time of the resin particles in the flame. Nevertheless, a practical limit of flame temperature exists for spraying resinous particles since surface degradation or scorching of the particle can occur even for a minimum residence time.

RESIN PARTICLE SIZE

Resin particles having a maximum thickness of less than about 100 microns are found to possess good characteristics for forming coatings when sprayed through a plasma arc gun. Optimum results are achieved when little variation in size exists among the particles. The resin particles must be sufficiently small to be transported to the spray gun by entrainment in a gas stream; however, particles substantially larger than 150 microns are readily transported by such a system.

Particles having a maximum thickness less than 100 mesh (approximately 150 microns) readily liquify upon sufficient exposure to a temperature exceeding the resin melting point. The relationship of melt efficiency to particle size is illustrated in FIG. 1.

PARTICLE VELOCITY

Although the importance of elevating the temperature of the particle above the catalyst activation temperature and preferably above the resin melting point is readily recognized, the importance of particle velocity is less apparent. Significantly, though, particle velocity is particularly important in applying thermosettable resin particles as a thin, cured, continuous coating on a substrate. As indicated hereinabove, only a certain amount of thermal energy can be imparted to a particle since the degradation temperature must not be exceeded. However, substantial kinetic energy may be imparted to the particle without danger of resin degradation. Kinetic energy of a particle is computed from the formula $E = 1/2\ mv^2$ wherein E is energy, m is mass and v is velocity. The energy relationship of two particles of equal mass is proportional to the ratio of the square of their respective velocities, as shown:

$$\frac{E_1}{E_2} = \frac{\frac{1}{2} m_1 v_1^2}{\frac{1}{2} m_2 v_2^2} \text{: when } m = m\text{, then } \frac{E_1}{E_2} = \frac{V_1^2}{V_2^2}$$

Thus, the kinetic energy possessed by a particle having double the velocity of another particle is four times the latter when the particle masses are equal. Kinetic energy of a particle is an important factor in forming continuous films; i.e., films of less than one mil in thickness which cure to a substantially fully cured state without receiving energy from any source other than the thermal and kinetic energy possessed by said particle and perhaps some incidental radiant energy emitted by the plasma flame. It is significant that no additional thermal energy is required to cure the film. It has been found that a minimum particle of velocity of about 500 ft./sec. is preferred to obtain thin, cured films from substantially liquified resin particles. Optimum velocities from about 500 ft./sec. up to or in excess of sonic velocities are preferred for most applications of thermosetting resinous particles by a plasma arc spray gun with velocities of about 700 ft./sec. to about 1000 ft./sec. being particularly useful in imparting a desired level of kinetic energy but yet avoiding the acoustic problems associated with sonic and supersonic velocities.

GAS COMPOSITION

Although various gas compositions can be ionized in a plasma arc gun, inert gas compositions comprising argon, nitrogen and helium are preferred for the purposes of this invention. Gas composition is one factor which determines flame temperature and is one controllable variable in selecting an appropriate flame temperature for a particular thermoset resin.

The following are ionization temperatures for some inert gases:

| | |
|---|---|
| Argon | 10,000°C |
| Nitrogen | 19,000°C |

Certain thermosetable materials may be effectively sprayed in an ionized argon gas stream; however, a mixture of argon and nitrogen is typically used. Although other ionizing gases having a higher ionizing temperature may be utilized, such use generally requires the addition of a diluent, cooling gas to regulate the flame temperature. Since it is a more efficient use of power to use an ionizing gas producing a flame temperature approximating the desired temperature, those gases having low ionizing temperatures are generally preferred. Nitrogen, because of its availability at a relatively low cost is preferred as an additive to the lower ionization temperature gases, such as argon, when it is desired to raise the flame temperature. Also, nitrogen may be used as the sole ionizing gas by the expedient of adding additional nitrogen as a cooling, diluent gas near the gun nozzle.

Thermosettable resins may be effectively sprayed in an ionized argon stream or a stream of argon and nitrogen.

A pure nitrogen stream produces very high temperatures which tend to scorch or burn resinous particles unless a diluent or cooling gas is introduced into the plasma arc gun at some point between the plasma chamber and the gun nozzle exit. Argon is particularly useful because of the relatively low temperature flame generated.

Figure 2:
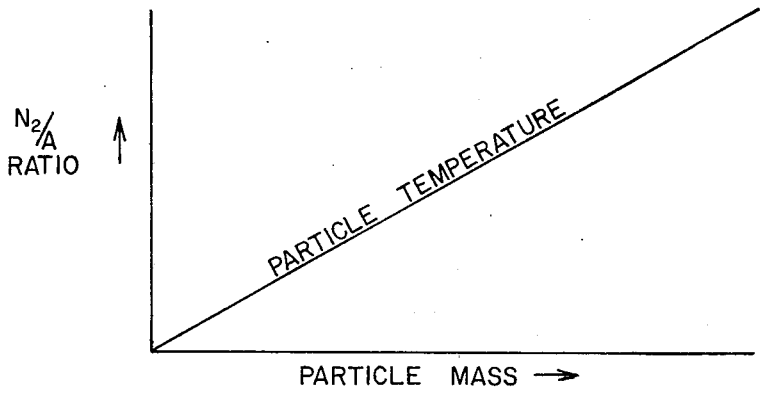
FIG. 2 graphically illustrates the relationship between particle mass, gas composition and particle temperature.

Because of the low ionizing temperature of argon and the availability of nitrogen, these two gases are generally preferred for use in forming coatings of thermoset resins. It has been determined that a relationship exists between particle mass and gas composition in establishing particle temperature, as indicated in FIG. 2 wherein argon and nitrogen gases are utilized to illustrate the effect.

As particle mass increases, a hotter flame is required to maintain the same average particle temperature. Particle mass is a function of particle volume and density. This relationship between gas composition and particle mass exists for particles less than about 100 microns in thickness. Particles having a thickness greater than 100 microns have poor heat transfer in plasma spray apparatus and tend to suffer surface scorching as the flame temperature is increased to heat the interior of the particle.

Varying gas composition to accommodate particle mass is one method of varying flame temperature. The voltage applied to the gun must be varied as gas composition varies; for example, a higher applied voltage is necessary for nitrogen than for argon.

Most thermosetting resins can be effectively applied as a cured coating by utilizing an argon-nitrogen gas mixture wherein the nitrogen is from 0 to about 50 percent by volume of the mixture. Larger percentages of nitrogen can be used, as indicated hereinbefore, by utilizing a diluent gas introduced into the ionized gas after it has passed through the ionizing chamber.

SPRAY PATTERN

To form thin cured coatings from thermosettable resinous particles it is necessary to have the liquified particles uniformly applied and to have flow occur on the substrate. Flow of resin upon the substrate can be observed as the coating is applied. If the resin does not appear to be flowing upon the substrate then the application conditions are inappropriate for formation of a thin, cured coating; for example, the resin particles are not liquified or the velocity is not high enough or the gun to substrate distance is too great.

In order to achieve a cured thermoset film it is preferred that the spray pattern be directed upon the substrate for some finite period of time in the order of two to three seconds for an area the size of the spray pattern. Faster exposure tends to result in an undercured film having less desirable film properties.

A circular spray pattern is desired. A typical pattern has a one inch diameter upon a substrate located two inches from the gun nozzle. A pattern of this type at a resin feed rate of approximately fifty grams/minute will uniformly continuously coat at a thickness of less than one mil, at a rate of 220 lineal feet per minute.

RESIN FEED RATE

The resin feed rate is varied to apply a predetermined coating thickness. In applying a substantially cured coating, it is preferred to expose a substrate area of about twice the spray pattern for a period of about five to six seconds. Thus, for a gun spraying an area of about six square inches at a distance of about five inches from the nozzle, an area about ten to fifteen square inches can be coated in five to six seconds. A typical epoxy resin has a film weight of about 20 mgs. per square inch of coating at a thickness of about one mil. To cover fifteen square inches in six seconds with a film one mil thick requires a resin feed rate of about three grams per minute. To cover the same area with a 0.5 mil film requires about 1.5 grams per minute.

The correct resin feed rate may be calculated by determining the area of the spray pattern at a given spraying distance; e.g., about four to eight inches from the substrate. The pattern area in inches is then multiplied by the desired film weight per square inch. The total film weight for the spray area is preferably applied in about two to three seconds. Thus, a resin rate in unit weight per unit time can be easily determined. The rate of resin feed must be substantially uniform otherwise the film thickness will vary inordinately.

The techniques of this invention permit the rapid coating of a substrate with a cured, thermoset film having a thickness of less than one mil from solid, resinous particles. Thick films may be applied without observing the techniques described herein; however, the economics of organic coatings dictate the use of ultra thin coatings; i.e., those having a thickness of one mil or less, where service permits. Certain end uses such as container coatings, especially beverage containers, typically utilize coatings with thicknesses of about 0.5 mil or less.

RESIN COMPOSITION

Thermosetting resins having a chemical structure similar to those used in electrostatic and fluid bed coating processes are generally useful in the instant invention. Such powdered resins particularly include epoxy, epoxy-phenolic, epoxy-urea and epoxy resin compolymers.

Epoxy resins particularly useful in the instant invention are those resins having the following characteristics:

| | Useful Range | Preferred Range |
|---|---|---|
| Molecular weight | 1000 to 5000 | 1500 to 3000 |
| Epoxide equivalent | 500 to 1500 | 700 to 1500 |
| Melt Viscosity at 160° (centipoise) | 100 to 5000 | 200 to 2000 |
| Softening Point °C | 60 to 150 | 75 to 125 |
| Gel Time at 175°C (sec) | 30 to 120 | 30 to 100 |

Typical epoxy resin powders are derived from bisphenol "A" and epichlorohydrin. Certain properties of a given resin are dependent upon molecular weight (e.g., melt viscosity and softening point), although the addition of multi-functional resins to the the epoxy will alter these characteristics. Typical multi-functional resins useful for this purpose include low molecular weight epoxy-novolac resins. Epoxy-novolac resins generally possess a much lower melt viscosity than a bisphenol "A" based resin of the same softening point.

Typical curing agents utilized in epoxy resin compositions may be classified as follows:

Catalytic curing agents
Aromatic amines
Epoxy-amine adducts
Acid-anhydrides

Dicyandiamide is the most significant catalytic curing agent utilized in epoxy resin powders. Substituted dicyandiamide may also be utilized. Epoxy resins containing dicyandiamide and substituted dicyandiamide have good storage stability and cure at a fast rate.

Dicyandiamide is generally accompanied by an accelerator such as:

| | |
|---|---|
| guanadines | piperidine |
| pyridine | piperazine derivatives |
| triazines | imidazoles |
| hydrazines | urea derivatives |

Epoxy resins catalyzed with accelerated dicyandiamide have cure rates of about three to five minutes at 200°C.

Dicyandiamide catalyzed resins are preferred for comestible coatings since dicyandiamide is an FDA approved catalyst for food grade coatings. Additionally, dicyandiamide catalyzed epoxy resin powders were found to apply well and cure effectively when applied to substrates by the techniques of the instant invention.

Aromatic amines, epoxy-amine adducts and acid anhydrides are less prevalent as catalysts for epoxy resin powders than dicyandiamide. Aromatic amines, such as methylene dianiline, m-phenylene diamine, diaminodiphenylsulfone and the like, provide cured films with improved flexibility and corrosion resistance.

Aromatic amines are preferably utilized as an adduct of an epoxy resin, which improves shelf life of an aromatic amine catalyzed resin.

Trimellitic anhydride, chlorendic anhydride, and the like, are typical anhydride curing agents for epoxy resin powders. Anhydride cured epoxy coatings normally have poorer flow than dicyandiamide cured systems but contribute better corrosion resistance and hot water resistance.

Additives, such as flow modifiers are frequently added to modify the wetting characteristics of the molten epoxy resin. Typical flow modifiers include ethyl cellulose, polyvinyl butyrates, polyvinyl formates, polyethylene copolymers and the like.

Typical commercial epoxy resins useful in the instant invention include:

Epon 1001
Epon 1004
Epon 1007

Epon is a trademark of Shell Chemical Co.

A preferred composition comprises a blend of Epon 1001 and 1004 in equal proportions. Blends of the above three resins give a spectrum of melt viscosities.

In addition to epoxy resins, thermoset acrylic resin powders are particularly useful. Acrylic resin powders have a good melt viscosity range for plasma spray techniques and generally have better temperature stability than epoxy resins. Acrylic resin powders preferred for plasma spray application are hydroxyl or carboxyl functional acrylates which cross-link with block isocyanates, methylated melamine, butylated melamine and the like.

Commercial acrylic resin useful in the invention include: Sherwin Williams-Powdura, -SA8621- Particle Size — 100% less than 100 microns, 70%-30–50 microns Specific Gravity 1.48

A plasma flame generator such as the plasma spray device described herein produces a substantial amount of ultraviolet radiation. Thermoset resin particles containing ultraviolet sensitizers or activators are particularly useful in the instant invention. Such resin particles cure rapidly when applied according to the techniques of the instant invention.

Typical ultraviolet (UV) sensitizers or activators include:

— Benzophenone Derivatives
— Lewis Acid Blocked Catalyst

The UV sensitizers or activators are included as about 0.1% to about 5.0% by weight of the resin.

Utilization of thermoset resin particles which include an ultraviolet sensitizer and a fast-acting catalyst in a plasma spray process of the instant invention provides a system which rapidly coats substrates with a cured thermoset film of any desired thickness. As indicated in the discussion herein of fast-acting catalysts, rapidly curing resin powders are not useful in other processes such as the electrostatic spray.

MELT VISCOSITY

Application of thin films of thermoset resins by plasma spray techniques may involve resins with a relatively wide range of melt viscosities. A resin having a high melt viscosity, however, requires greater impact energy to cause the resin to flow into a thin, continuous film. Even with high impact energy, resins having high melt viscosities require optimum conditions of particle size flame temperature, gas velocity, substrate distance, spray pattern and the like in order to form a thin film. Resins having moderate to low melt viscosities are more easily sprayed by plasma spray techniques to form thin films. Useful melt viscosities are less than about 5000 centipoise with preferred melt viscosities being less than about 2000 centipoise. Best results for ultra thin films are achieved with resins having melt viscosities less than about 1000 centipoise and particularly less than 500 centipoise.

The melt viscosity of a resin is generally determined by resin composition; i.e., the chemical structure of the polymer backbone and pendant groups, and molecular weight. Most thermosetting resins are low molecular weight resins which cross-link at elevated temperatures to form three dimensional polymers. The melt viscosity referred to herein is the viscosity of the low molecular weight thermosettable resin.

Resins having particularly useful melt viscosities include low to medium molecular weight epoxy, epoxy-phenolic, epoxy-urea and like epoxy resin copolymers. Preferred molecular weight for such polymers ranges from about 1000 to about 5000 with best results achieved from resins with molecular weights ranging from about 1500 to about 3000.

CURING TEMPERATURE

Although plasma arc spray devices can successfully apply metals and thermoplastic resins such as tetrafluoroethylene which have high melting points, the formation of cured thin thermoset resin films is facilitated through the use of resins which have relatively low curing temperatures; e.g., below about 400°F and preferably below about 350°F. Thin films have a large surface to volume (or mass) ratio. Heat loss from thin films occurs rapidly because of the high surface area to mass ratio. Thin films of thermosetting resins having a low curing temperature cure to a substantially fully cured state when applied by a plasma spray device according to the techniques of this invention.

Following the techniques described herein a glossy, cured thermoset film having a thickness of less than one mil can be applied from powdered resin sprayed through a plasma arc device. The resulting film requires no further processing to achieve a cured state. A second film may be applied over the first almost immediately upon application of the first. The curing cycle is very short, in the order of about three to five seconds.

The cured film is significantly different from films applied by other techniques; e.g., electrostatic spraying of powder resins which are generally in excess of about one and one-half mils having a non-gloss, uncured surface. Electrostatically applied films of thermosetting resins require heating for periods of ten minutes and more at temperatures in excess of about 400°F.

The following examples illustrate the manner of applying thermoset resinous coatings by a plasma spray technique.

EXAMPLE I

A plasma spray gun having a nozzle diameter of 0.228 inches, a power supply capable of supplying a range of power from 50 mps amps and 30 volts to about 150 amps and 55 volts was utilized in the following experiment.

Inert gas was supplied to the above described gun to be ionized to produce a "plasma flame". Inert gas may be supplied to the above described gun at various rates, dependent upon the gas, while maintaining a stable flame. In the following experiments argon and nitrogen gases were supplied to the gun. Argon alone may be supplied to the gun at a rate of from about 15 cfh (cubic feet per hour) to about 40 cfh. Nitrogen, because of its high temperature of ionization, is usually supplied to the gun in conjunction with another gas such as argon when the thermosettable resins are sprayed. Nitrogen is usually present as less than 50 percent by volume of the ionizing gas and preferably less than 30 percent of the volume. The volume rate of ionizing gas usually does not exceed 40 cfh whether a single gas or gas mixture is being supplied to the gun.

EXAMPLE II

In the following experiments a thermosettable epoxy resin commercially identified as Epon 1004 (Shell Chemical Co.), whose characteristics are:

| | |
|---|---|
| Durran's Softening Point | 95 – 105°F |
| Gel Point | 30 Sec. at 350°F |
| Epoxide Equivalent | 730 – 840 |
| Catalyst | Dicyandiamide (2% by wt) |
| Particle size | 10 – 100 microns |

is supplied to the plasma spray flame externally to the gun from an outlet near the nozzle oriented so that the resin is projected into the flame at an angle of about 22° with reference to the longitudinal axis of the flame. The point of introduction of the resin into the flame is about three-eighths inch from the nozzle outlet.

The powdered resin was supplied to the gun by a powder feeder. The powder is entrained in an inert gas; the inert gas flow being about between 5 CFH and 20 CFH.

In each of the following experiments the nozzle of the gun was located from about three inches to about six inches from the substrate. Although lateral nozzle speed in relation to the substrate varied slightly during the various experiments, the approximate lateral nozzle velocity was 220 FPM.

In the following experiments 1 through 22 the velocity of the gas at the nozzle was calculated to be about 800 ft./sec. at gas flow greater than about 30 cfh. Since particle velocity, because of the small size of the particle, attenuates quickly in air, the velocity at impact depends directly upon nozzle to substrate distance.

Experiments

| No. | Gas Flow Argon/ Nitrogen Ratio (CHF) | Amp | Volts | Film Thickness | Copper Sulphate | Comments |
|---|---|---|---|---|---|---|
| 1 | 20 | 75 | 50 | Low | Poor | Very good reflow; dry spray |
| 2 | 20/5 | 50 | 45 | Medium | Good | Very good reflow; dry spray |
| 3 | 20/10 | 100 | 40 | High | Good | Wet spray; no reflow |
| 4 | 25/0 | 50 | 40 | 18.4 mgs./ sq. in. | Good | Dry spray; excellent reflow |
| 5 | 25/0 | 70 | 45 | 16.5 mgs./ sq. in. | Good | Dry spray; good reflow |
| 6 | 25/4 | 70 | 45 | | | Wet reflow; close to substrate |
| 7 | 20/5 | 70 | 45 | 22 mgs./ sq. in. | Poor | No reflow; close to substrate |
| 8 | 20/4 | 70 | 45 | | Good | Alum.; good reflow |
| 9 | 20/15 | 100 | 60 | | | Poor reflow; semi-wet |
| 10 | 20/4 | 70 | 45 | | | Dry spray; good reflow 2 min. gel |
| 11 | 20/4 | 70 | 45 | | | 10 min. at 400°F.; good solvent resistance |
| 12 | 20/4 | 70 | 45 | | | Excellent adhesion |
| 17 | 25/8 | 70 | 60 | 1 mil. | | 15 solvent rubs not cured |
| 18 | 25/8 | 70 | 60 | 0.9 mil. | | 3"from substrate; wet spray |
| 19 | 25/8 | 70 | 60 | 11 mgs./ sq. in. | Good | Wet spray |
| 20 | 25/8 | 70 | 60 | 10.6 mgs./ sq. in. | Good | Tin reflow |
| 21 | 20/10 | 70 | 60 | 11 mgs./ sq. in. | Good | Double plasma pass; excellent adhesion—pasteurization |
| 22 | 20/10 | 70 | 60 | 1.0 mil. | | Bake — good solvent Unbaked — poor solvent |
| 23 | 25/8 | 70 | 60 | *4.0 mgs./ sq. in. | Good | Wet Spray |

*Spray conditions were similar to Run 19 with a lower resin feed rate.

In the above experiments, a reported film thickness of 1 mil is equivalent to 20 mgs./square inch of coating. Thus, for very thin coatings (0.5 mil or 10 mgs./inch) the thickness is reported in coating weight per unit area since weight can be determined more accurately than thickness at these thicknesses.

An acidified copper sulfate solution is used to determine film integrity (porosity). Copper sulfate reacts with metallic substrates, thereby giving a positive visual indication of pores in a film.

In a number of the above experiments, for example, 1, 2, 5 through 8, 10 through 12, the resin was sprayed "dry"; i.e., it was melted sufficiently to adhere to the substrate and form a continuous, frequently pore free, adherent, hardened coating, but it was not sufficiently "liquified" to initiate polymerization since the coating reflowed when subjected to temperatures in excess of 400°F.

In experiments 17 through 22 the gas flow rate and, consequently, particle velocity, was increased as well as the power input (4.2 KW) and nitrogen percentage, which raises flame temperature. The resulting continuous films had film thicknesses of one mil and less with several films (experiments 19, 20 and 21) having thicknesses less than 0.55 mil (11 mgs./ sq. in.). These films had excellent adhesion and were substantially cured; i.e., the films had moderate solvent resistance and could be fabricated. Uncured films have no solvent resistance and cannot be fabricated. Also, these films did not reflow when subjected to temperatures in excess of 400°F. Exposure of these films to temperatures in the range of 400°F. for periods of about one to three minutes resulted in a fully cured film having excellent solvent resistance. The films from experiments 1 through 13 had to be exposed about ten minutes at 400°F. to achieve a complete cure.

In experiment 20 the temperature of the tin substrate exceeded 425°F. Tin reflows at this temperature exhibiting a change in crystal habit which was detected on the substrate from experiment 20. The remaining experiments 17, 18, 19, 21 and 22 showed no tin reflow, thereby establishing that a substantially cured thermoset epoxy coating can be applied to a thin, metallic substrate without transferring substantial quantities of energy into the substrate.

In comparison with films from powdered resins applied by other techniques, the plasma spray technique of Example I indicates many advantages. Films less than one mil thick are not easily applied by electrostatic techniques; also, electrostatically applied powder coatings can be cured only by being subjected to elevated temperatures for substantial periods of time; e.g., an oven, which transfers substantial energy to the substrate as well as to the film. Electrostatically applied films of less than one mil require extremely fine particles, generally about 5 – 10 microns ±. The sizing and classification required to obtain such fine, uniform particles is expensive. Also, extremely fine powders present an explosive hazard.

EXAMPLE III

A further experiment utilizing a plasma spray gun of the same size was conducted wherein argon was utilized at a rate of 17 cfh as the ionizing gas. An epoxy powder identical to that utilized in Example I was fed at a rate of about three to ten grams per minute at a carrier gas rate of about ten cfh. The power supplied to the gun was about 80 amps at 35 volts.

A cured epoxy film about one mil thick resulted when the spray gun was directed at a substrate about three mils thick located about five inches from the gun nozzle for a period of about six seconds. The film was smooth and pore free.

EXAMPLE IV

An experiment was conducted to compare the effectiveness of introducing thermal energy into the coating through the substrate rather than through the resin particles.

A thin substrate about three mils thick was heated to about 400°F. A fine dusting of unheated resin powder was applied to a low velocity to the substrate to form an adherent, discontinuous film about one mil thick. The resulting film was uncured inasmuch as the film was easily removed with solvent and heating of the film above the melting point of the resin caused the resin to melt and flow.

Although the quantum of thermal energy possessed by the substrate greatly exceeded the thermal energy possessed by the resin particles in Examples I and II, the resin particles contacting a very hot substrate did not cure until the coated substrate was postheated at a temperature of about 350°F for a period sufficiently long to effect curing of the coating.

The invention described herein is particularly advantageous for applying thin, thermoset resinous coatings to various types of substrates including wood, paper and the like, as well as metal. Following the techniques of this invention, thermoset coatings are applied which cross-link sufficiently to achieve at least a gel state, i.e., a state at which the resin does not reflow even though exposed to elevated temperatures for considerable periods of time. Typical commercial thermoset resin powders used for coating purposes have a gel point of about 90 seconds at 150°F. In Example I herein the gel point was indicated as 30 seconds at 350°F. In the instant invention the gel condition is achieved in a fraction of the time required in other coating techniques, for example, the gel condition is achieved in less than five seconds and generally less than three seconds with gel conditions frequently achieved in less than a one second application of energy wherein the resulting film was cooled to determine the state of gel.

The significance of achieving a gel condition in a few seconds is realized when comparisons are made to conventional powder coating techniques; e.g., electrostatic spray wherein about 40 percent of the energy required to cure completely a coating is consumed in achieving the gel condition. A typical thermoset epoxy resin coating applied by electrostatic techniques is cured in an oven at 400°F for 10 minutes. About four minutes of the oven time is required for the coating to achieve the ambient temperature and to gel. Thus, a resinous thermoset coating applied by the techniques of this invention which achieves the gel condition can be fully cured by exposure to elevated temperatures for a much shorter period of time than ungelled coatings.

The time required to achieve a gel condition can be shortened by utilizing a rapidly acting cayalyst. This approach is not practicable for powder coatings applied by conventional techniques inasmuch as a certain period of time at elevated temperatures is required to permit the powder to melt and flow into a smooth, continuous coating. The characteristics of the instant plasma spray technique, however, provides a smooth, continuous coating immediately upon impact of the resin particles with the substrate.

Utilization of faster acting catalysts in resin powders for the plasma spray process of this invention is advantageous inasmuch as the efficiency of the system is enhanced. A resin particle containing a fast-acting catalyst, e.g., a catalyst having a gel time of thirty (30) seconds at 150°F, cures substantially instantaneously upon impact with a substrate. Less care is required, therefore, to prevent energy loss from the coating immediately after application. Fast-acting catalysts are defined for these purposes as ones which provide a gel time of no greater than thirty (30) seconds at 150°F which, for epoxy resins, include blocked aliphatic amines wherein the blocking is removed at the gel temperature.

A further advantage of the instant invention resides in its ability to apply a coating which undergoes very little shrinkage after application. Resinous thermoset coatings, particularly epoxy coatings, undergo shrinkage during melting and curing. Thus, an epoxy coating applied by an electrostatic spray process or other process which applies an uncured coating which must be heated in an oven or by another device for a substantial period at elevated temperatures above the melting point of the resin shrinks upon gelling and curing and tends to pull away from the edge of coated articles. Less coating shrinkage is involved in the plasma spray process since the individual particles undergo shrinkage either during travel to the substrate or shortly thereafter.

The advantages of the plasma spray process are especially realized in applying thin coatings. Films having a thickness less than 0.5 mil can be applied by the plasma spray process from particles having an average particle size between 30 and 70 microns. In contrast, the formation of thin films of about 0.5 mil by an electrostatic process requires very careful sizing and screening so that the majority of particles have a thickness less than 15 microns. The plasma spray process contributes substantial energy, thermal and kinetic, to the resin particles prior to their contact with the substrate. In constrast, an electrostatic spray process introduces no thermal and substantially no kinetic energy to the sprayed particles. Electrostatically applied coatings depend upon thermal energy applied subsequent to the spraying, e.g., by an oven or the like, to cause the resin to flow and cure. Coatings as thin as 0.2 mil (about five microns) are attainable through the plasma spray process through use of particles having a majority of particles with a thickness of 30 microns.

We claim:

1. A method of plasma spraying cured thermoset coatings comprising:

a. continuously introducing thermosettable resinous particles having a maximum thickness of less than about 100 microns into a region of a high velocity, plasma arc generated flame having a temperature substantially greater than the melting point of said resin, said particles being introduced externally to a device generating said plasma flame;

b. maintaining the residence time of said resinous particles in said flame region for a period sufficiently long to impart sufficient thermal and kinetic energy to said particles to polymerize the resins of said particles to a substantially cross-linked or cured state upon impact with a substrate, but wherein said thermal energy alone is insufficient to polymerize said resin to said cured state;

c. propelling said resinous particles towards a substrate with sufficient velocity to cause impact with sufficient force to cause said particles to flow upon said substrate to coat same with a continuous, thin coating; and d. cooling said coated substrate at a rate sufficiently slow to assist the curing of said coating.

2. The method of claim 1 wherein said thermal energy imparted to said particles is sufficient to liquify substantially said particles.

3. The method of claim 1 wherein said resinous particles have a melt viscosity of less than about 2000 centipoise.

4. The method of claim 1 wherein said resinous particles have a curing temperature of less than 400°F.

5. The method of claim 1 wherein the residence time of said resin particles in the vicinity of said flame is from about one-five-thousandths second to about one-five-hundredths second.

6. The method of claim 1 wherein said resin particles are propelled at a velocity of at least 500 ft./sec.

7. The method of claim 1 wherein said flame is generated from ionized argon.

8. The method of claim 1 wherein said flame is generated from an ionized gas mixture of nitrogen and argon.

9. The method of claim 6 wherein nitrogen is present as at least 20% of the ionizing gas volume.

10. The method of claim 1 wherein said substrate is located at a distance of from about three to about six inches from the introduction point of said resinous particles into said flame.

11. The method of claim 1 wherein the thermosettable resinous particles are epoxy resin particles.

12. The method of claim 1 wherein the thermosettable resinous particles are acrylic resin particles.

* * * * *

UNITED STATES PATENT AND TRADEMARK OFFICE

CERTIFICATE OF CORRECTION

PATENT NO. : 3,962,486

DATED : June 8, 1976

INVENTOR(S) : Gene Gerek & Robert G. Coucher

It is certified that error appears in the above-identified patent and that said Letters Patent are hereby corrected as shown below:

Col. 2, line 23, change "paraticle" to ---particle---;

Col. 2, line 35, change "rection" to --- reaction---;

Col. 2, line 48, change "meelt" to ---melt---;

Col. 8, line 31, change "com-" to ---co---;

Col. 14, line 14, change "to" first occurrence to ---at---.

Signed and Sealed this

Twenty-third Day of November 1976

[SEAL]

*Attest:*

RUTH C. MASON
*Attesting Officer*

C. MARSHALL DANN
*Commissioner of Patents and Trademarks*